US005161998A

United States Patent [19]

Defibaugh et al.

[11] Patent Number: 5,161,998

[45] Date of Patent: Nov. 10, 1992

[54] PANEL POLARIZATION FEATURE

[75] Inventors: George R. Defibaugh, Mechanicsburg; Benjamin H. Mosser, III, Middletown, both of Pa.

[73] Assignee: AMP Incorporated, Harrisburg, Pa.

[21] Appl. No.: 776,536

[22] Filed: Oct. 11, 1991

[51] Int. Cl.[5] ..... H01R 13/74

[52] U.S. Cl. ..... 439/544; 439/677

[58] Field of Search ..... 439/540, 544, 566, 569-572, 439/609, 677, 248

[56] References Cited

U.S. PATENT DOCUMENTS

| | | | |
|---|---|---|---|
| 4,150,867 | 4/1979 | Knickerbocker | 339/97 P |
| 4,389,021 | 6/1983 | Coldren | 339/126 R |
| 4,422,700 | 12/1983 | Krenz | 339/14 R |
| 4,572,602 | 2/1986 | Rupnik | 439/544 X |
| 4,629,266 | 12/1986 | Viselli | 339/17 LC |
| 4,770,645 | 9/1988 | Antes | 439/329 |
| 4,895,535 | 1/1990 | Emadi et al. | 439/681 |
| 4,921,441 | 5/1990 | Sauder | 439/460 |

*Primary Examiner*—Eugene F. Desmond

*Attorney, Agent, or Firm*—David L. Smith

[57] ABSTRACT

There is disclosed a panel providing a polarization feature to a connector proximate thereto. The panel has a face plate with opposed major surfaces. A complementary connector receiving aperture extends between the major surfaces. The aperture has a wider first region and a narrower second region. The narrower second region defines a portion of the panel adjacent thereto as a polarization feature that is adapted to be engaged by a portion of the complementary connector when the complementary connector is not properly oriented for passing through the aperture. In this manner, a complementary connector having a mating face profile corresponding to the profile of the connector receiving aperture can pass through the aperture in one orientation but not in other orientations.

5 Claims, 9 Drawing Sheets

Fig. 4
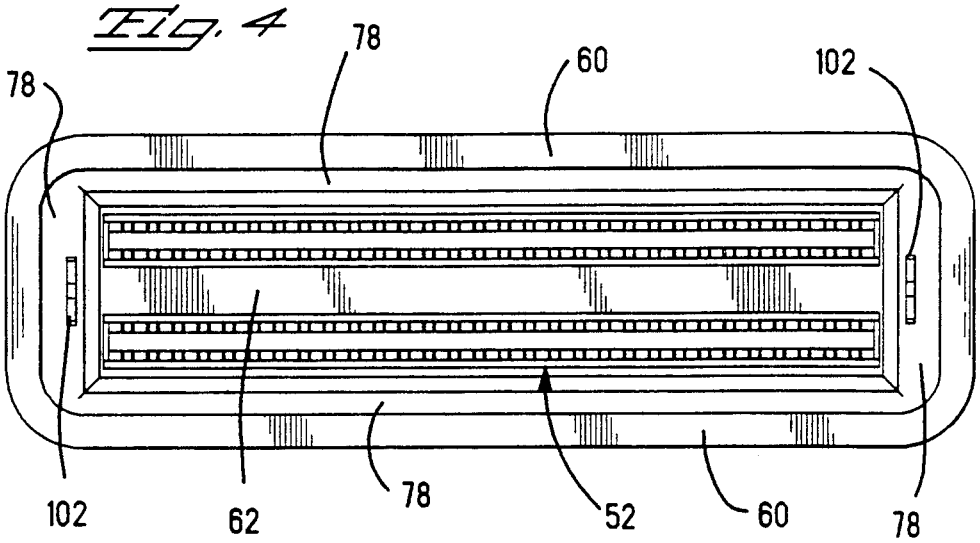
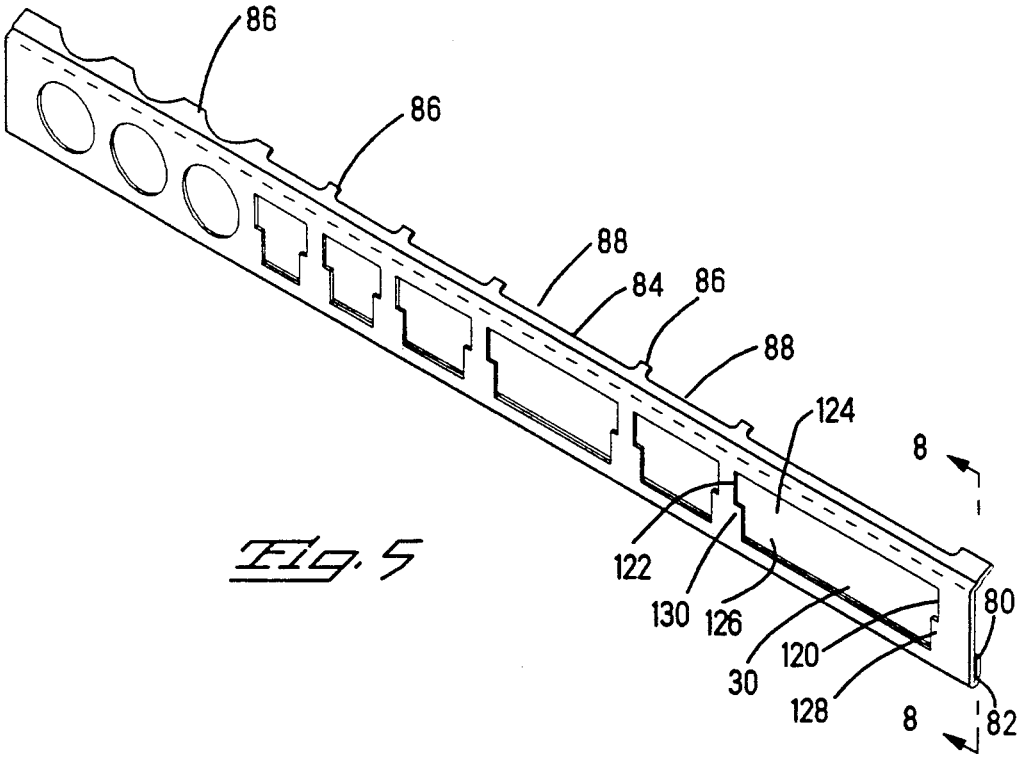
Fig. 5

PANEL POLARIZATION FEATURE

BACKGROUND OF THE INVENTION

This application relates to providing a polarization feature to assure that mating connectors are properly oriented with respect to one another prior to mating, and in particular to using a portion of the panel on which a connector is mounted or adjacent to a connector accessible through the aperture as a polarization feature to assure that the complementary connector mating with the connector mounted on or adjacent to the panel is properly oriented prior to mating.

Polarization features to assure that connectors are properly oriented for mating take many forms. U.S. Pat. No. 4,901,574 discloses a polarization system of ribs and channels in mating connectors. The connector disclosed in U.S. Pat. No. 4,921,441 is typical of connectors employing a trapezoidal or subminiature D configuration as a polarization feature. U.S. Pat. No. 4,629,266 discloses a connector system employing a receptacle housing cavity that has a stepped sidewall. Generically, these connector polarization features are structural features on the connectors that provide a polarization function.

It would be desirably to be able to provide a polarization feature for use with connectors that is not a structural feature on a connector.

SUMMARY OF THE INVENTION

In accordance with the invention, a panel provides a polarization feature to a connector proximate thereto. The panel has a face plate with opposed major surfaces. A complementary connector receiving aperture extends between the major surfaces. The aperture has a wider first region and a narrower second region. The narrower second region defines a portion of the panel adjacent thereto as a polarization feature that is adapted to be engaged by a portion of the complementary connector when the complementary connector is not properly oriented for passing through the aperture. In this manner, a complementary connector having a mating face profile corresponding to the profile of the connector receiving aperture can pass through the aperture in one orientation but not in other orientations.

BRIEF DESCRIPTION OF THE DRAWING

FIG. 4 is a mating end view of the connector of FIG. 2;

FIG. 6 is a rear view of the panel of FIG. 5;

DESCRIPTION OF THE PREFERRED EMBODIMENT

Figure 1:
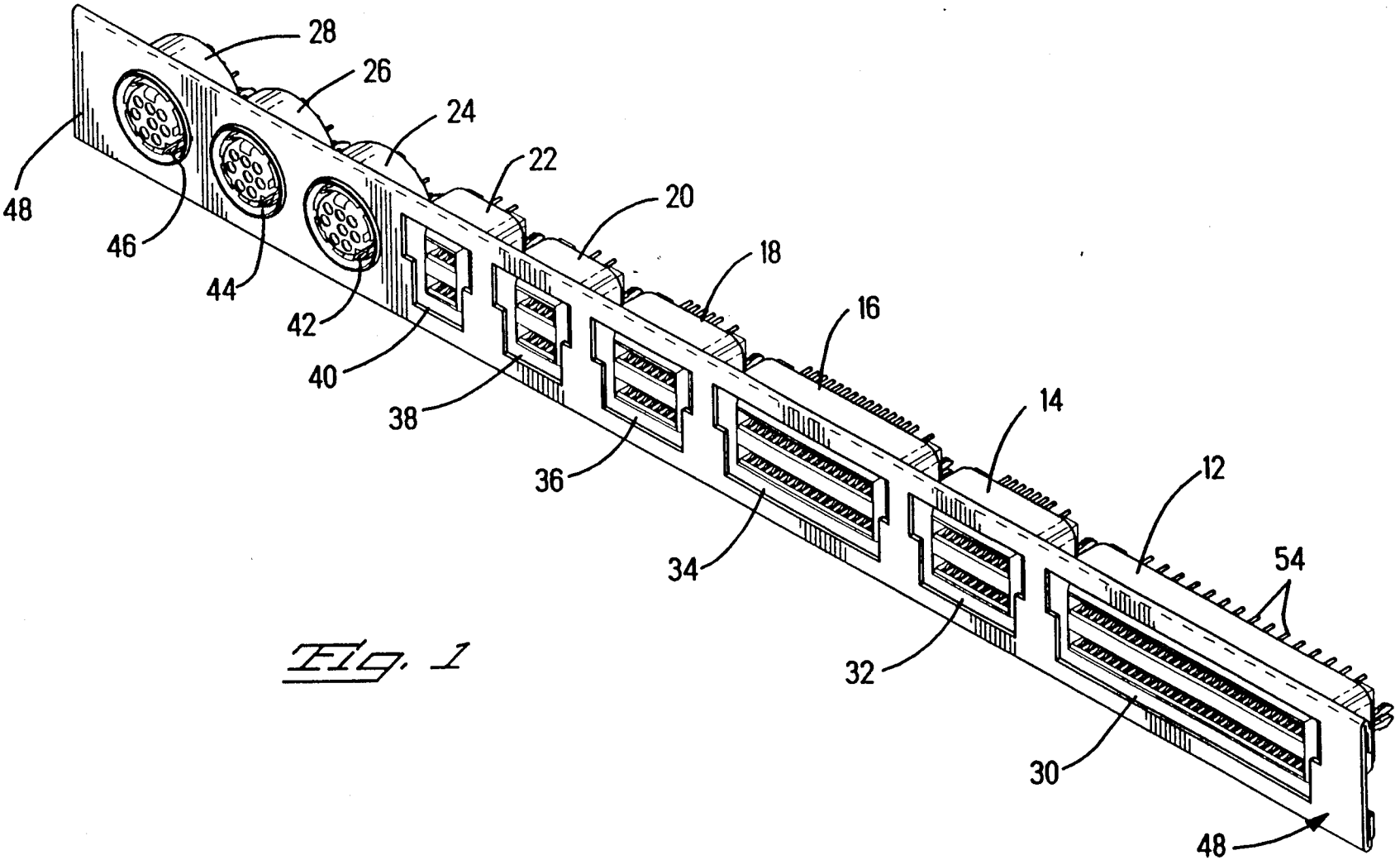
FIG. 1 is a perspective view showing a hardwareless panel retention for a plurality of shielded connectors, in accordance with the present invention.

A hardwareless panel retention system 10 for one or more connectors in shown in FIG. 1. Each connector 12-28 is mounted adjacent to a corresponding aperture 30-46 in panel 48. A complementary connector passes through the respective corresponding aperture to mate with a particular one of the connectors. For example, complementary cable terminated connector 50 shown in FIG. 12 will pass through aperture 30 to mate with connector 12.

Figure 2:
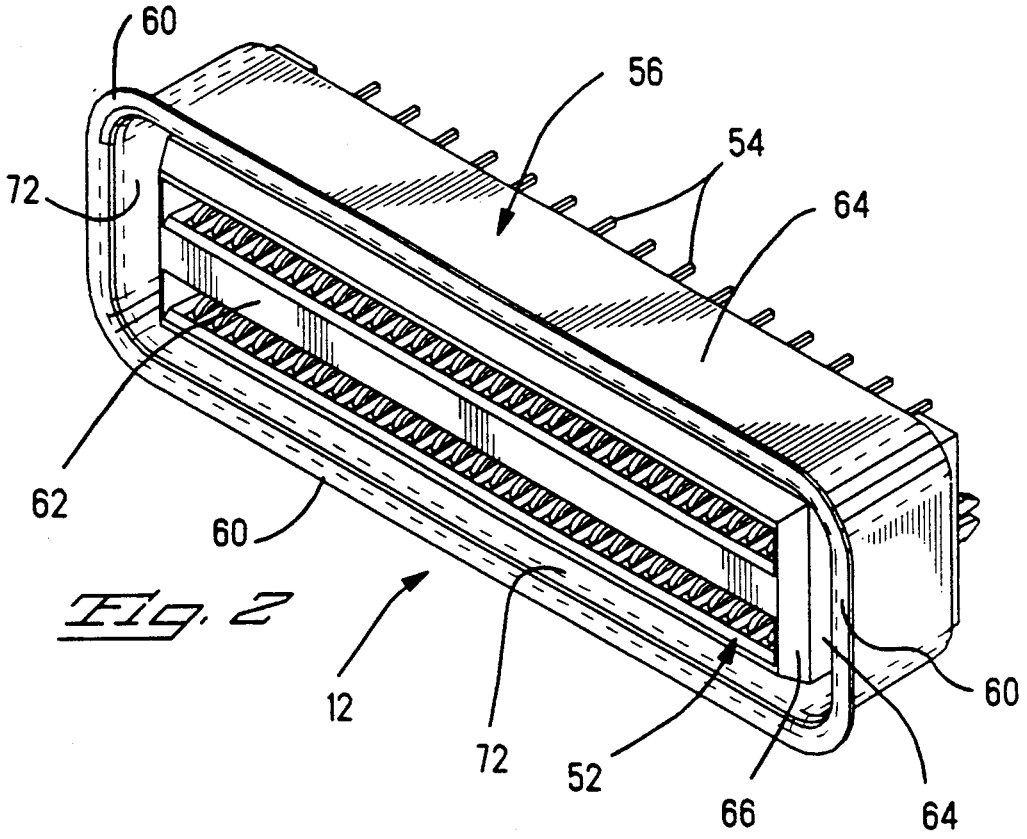
FIG. 2 is a perspective view of a connector adapted to be mounted to a panel by hardware retention.

As shown in the perspective view of FIG. 2, connector 12 includes a dielectric housing 52, contacts 54 and an electrically conductive shield 56. Housing 52 may be a slight modification of a known housing having known contacts 54 secured therein as taught by U.S. patent application Ser. No. 07/625,567 entitled Reduced Insertion Force Electrical Connector, filed Dec. 11, 1990, the disclosure of which is hereby incorporated by reference. Shield 56 in the preferred embodiment is made of steel, but could be made of any suitable electrically conductive material.

Figure 3:
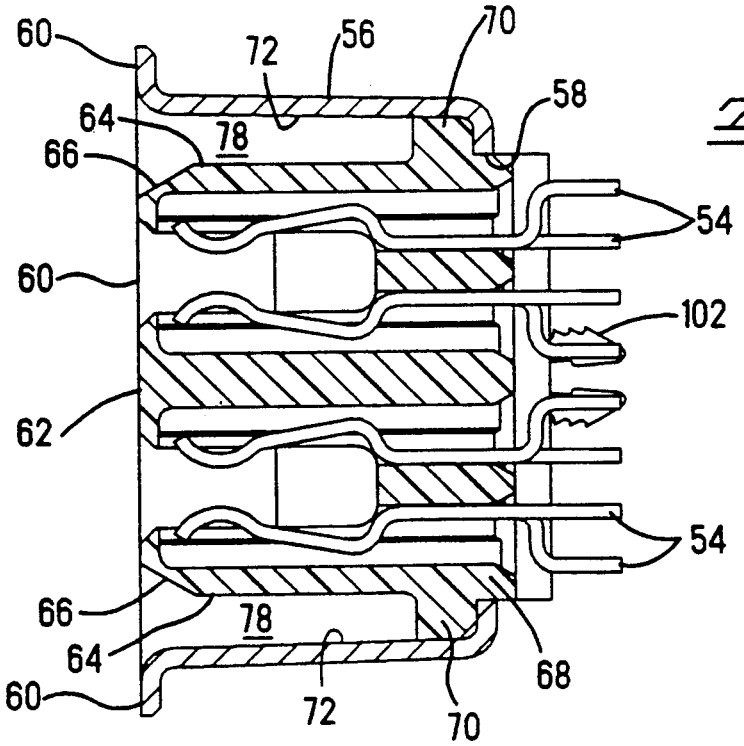
FIG. 3 is a side sectional view of the connector of FIG. 2.

Shield 56 is formed to have housing receiving aperture 58 in the rear and an outward turned flange 60 as best seen in the cross section FIG. 3. Flange 60 in the preferred embodiment extends along at least opposite edges of shield 56. Mating face 62 may be coplanar with the plane of flange 62, recessed within shield 56 or extend beyond the shield. In the preferred embodiment shown in FIG. 1, the mating face of connector 12 extends beyond the plane of flange 60 a distance substantially equal to the thickness of panel 48 with the result that the mating face of connector 12, or at least some of the connectors 12-18, are flush mounted with respect to panel 48. Proximate the intersection of peripheral walls 64 and mating face 62 are bevelled lead-ins 66 which cooperate with the leading edge of the shield of a complementary connector during mating to align the contacts of the respective connectors for mating.

With the rear portion 68 of housing 52 received in aperture 58, shield 56 is secured to housing 52 in any known manner, such as by an interference fit between flange 70 and the inside surface 72 of shield 56. The somewhat annular cavity 78 (best seen in FIGS. 3 and 4) between periphery walls 64 and inside surface 72 is sized to receive the shield 74 of mating connector 50. Shield 74 may have an outward projection 76 or shield 56 may have inward projections (not shown) as are known to enhance mechanical engagement therebetween and in turn assure electrical continuity therebetween.

Figure 5:
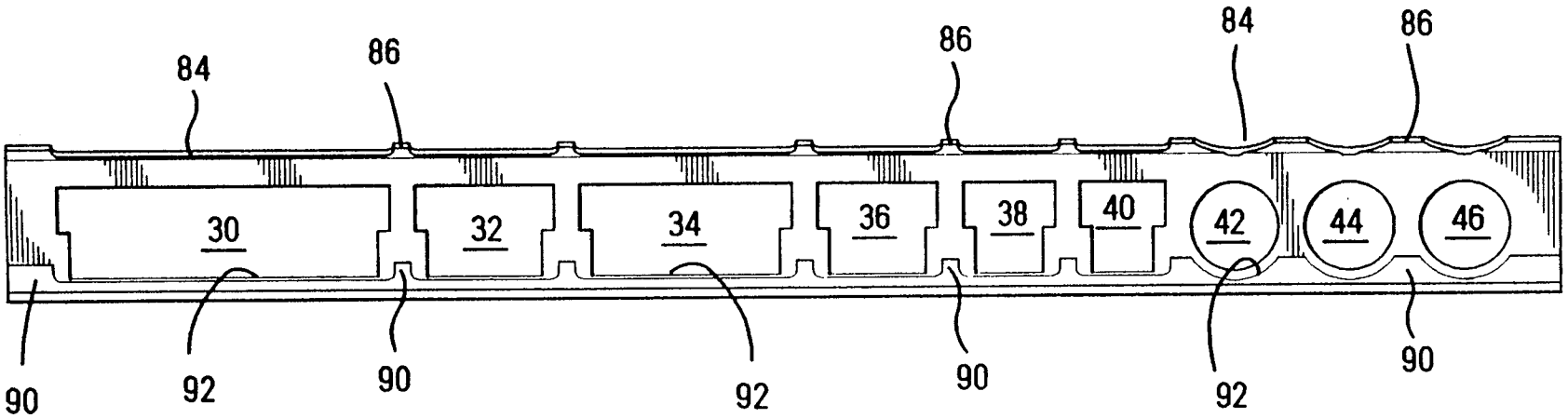
FIG. 5 is a perspective view of a panel prior to insertion of the connectors.
Figure 7:
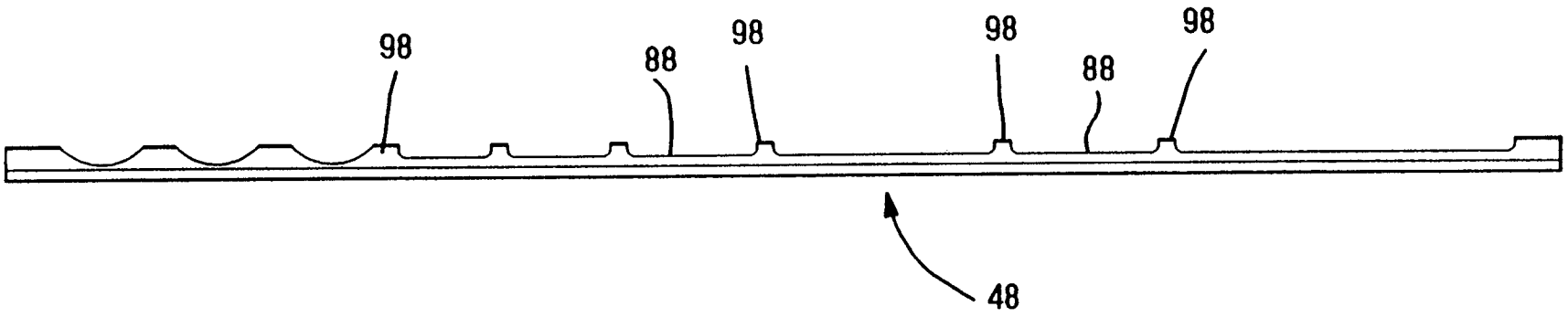
FIG. 7 is a top view of the panel of FIG. 5.
Figure 8:
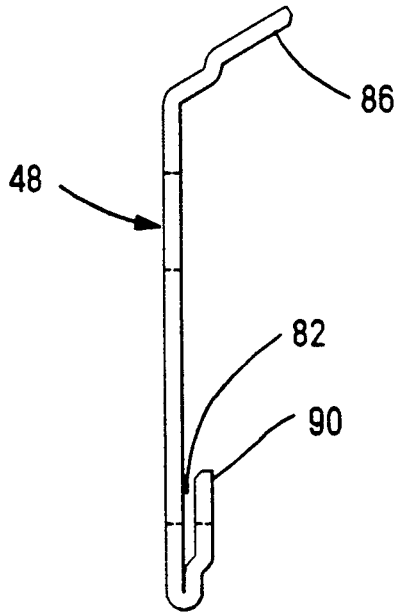
FIG. 8 is an end view of the panel of FIG. 5.

FIG. 5 shows a front perspective view of panel 48 having apertures 30-46 extending between major surfaces of the panel formed therein. The lower edge 80 of panel 48 has been formed over and rearwardly, upwardly defining channel 82 as seen at the right end of panel 48 and in FIG. 8. In a preferred embodiment, channel 82 has a gap between spaced surfaces of panel 48 that is substantially the thickness of or less than the thickness of flange 60. A typical channel may define a gap of 0.016 inches to receive connector flanges ranging between 0.018 and 0.022 inches. The upper edge 84 of panel 48 has been formed rearwardly out of the plan of the major portion of plate 48 having the apertures therein. The upper edge 84 is formed to an oblique angle to permit insertion and positioning of connectors in channel 82. Upper tabs 86 extend from upper edge 84 between adjacent apertures. Recesses 88, seen best in FIGS. 5-7, between tabs 86 accommodate the shield of a connector. Similarly lower tabs 90 extend from lower edge 80 between adjacent apertures and opposite tabs 86. Recesses 92 between tabs 90 accommodate connectors. The formed edge of panel 48 as well as tabs provide spring members to press flange 60 against the inside surface of panel 48.

Figure 9:
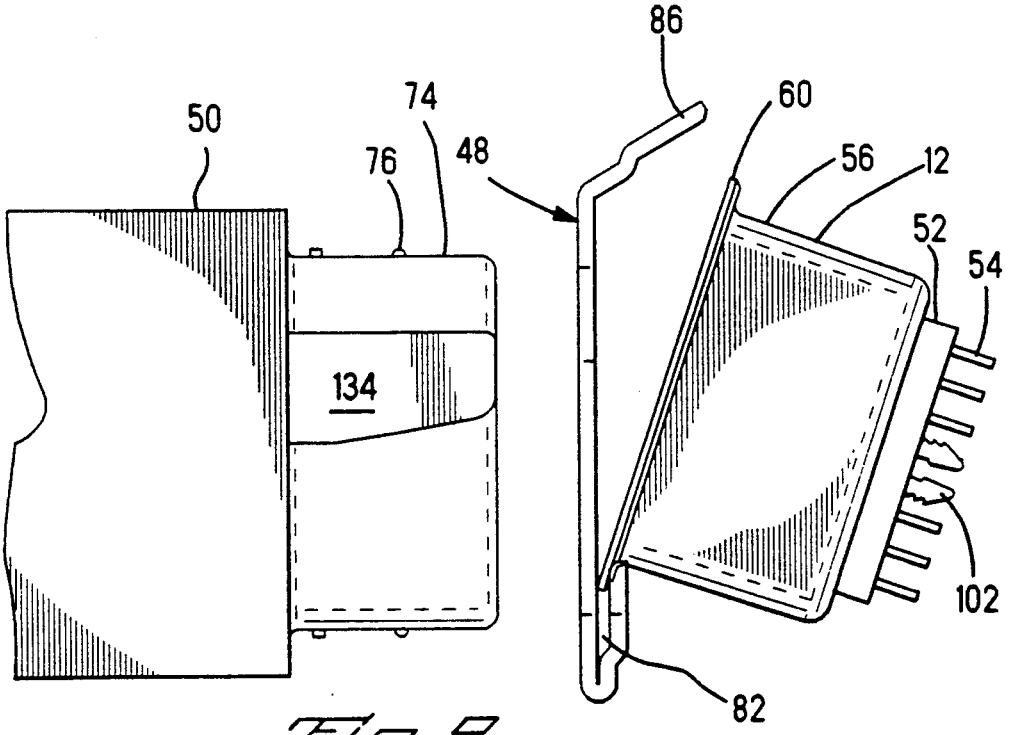
FIGS. 9-11 are an action sequence showing a side view of a connector being positioned in the panel and the upper tabs being formed to secure the connector to the panel.
Figure 10:
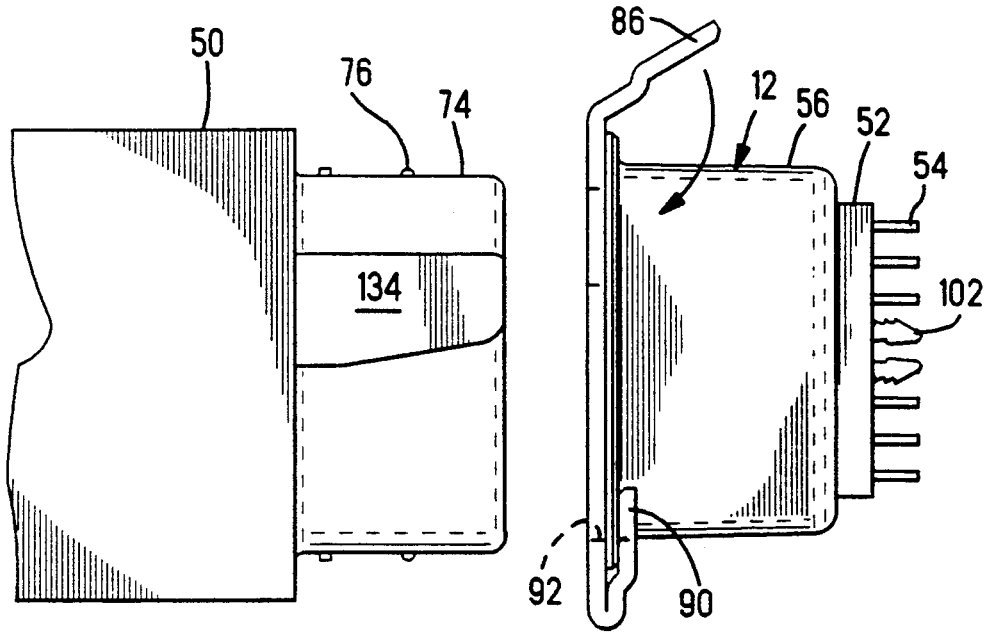

Connectors are secured to panels 48 by first inserting a connector behind a corresponding aperture such as connector 12 behind aperture 30. With the connector 12 at an angle relative to panel 48 as shown in FIG. 9, a first, lower portion of flange 60 is inserted into channel 82. Connector 12 is subsequently rotated, counterclockwise in FIG. 9, until flange 60 engages the rear surface of panel 48 as shown in FIG. 10. When panel 48 accommodates additional connectors, the additional connectors are then positioned in channel 82 adjacent to a respective aperture in a similar manner.

Figure 11:
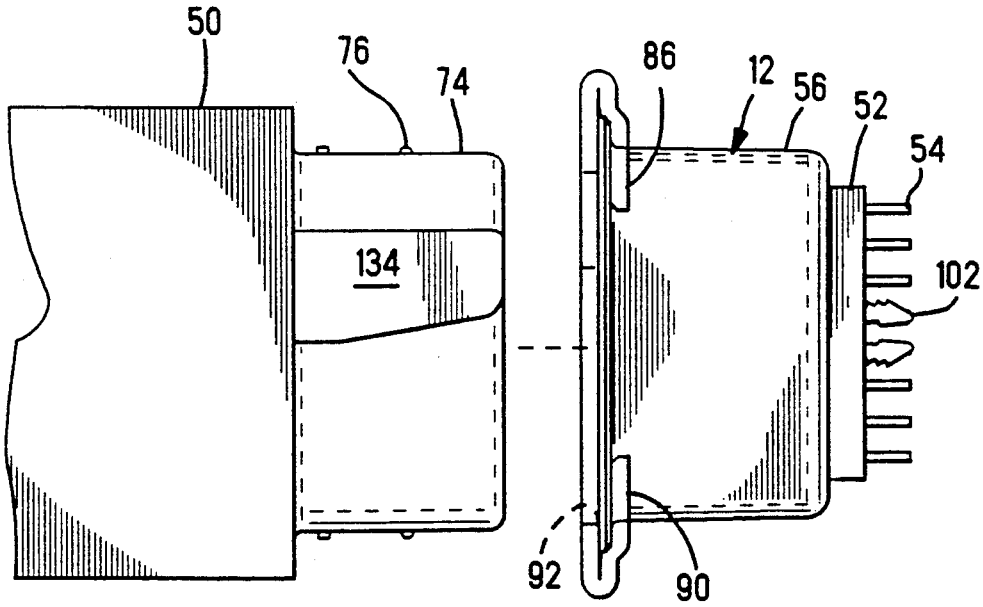

As shown in FIG. 11, upper edge 84 of panel 48 is then formed or crimped downward over a second, upper portion of flange 60 forming channel 94 with upper tabs 86 extending along a vertical portion of flange 60. Channel 94 is formed to be substantially the thickness of flange 60. Since the recesses 88,92 conform to the shape of a connector, flange 60 along each of the upper and lower edges is captured between surfaces of plate 48 in channels 82 and 94. With the flange around the periphery of shield 56 pressed against the rear surface of panel 48, very effective shielding is achieved. Tabs 86 and 90 enhance the retention of connectors on panel 48.

Figure 12:
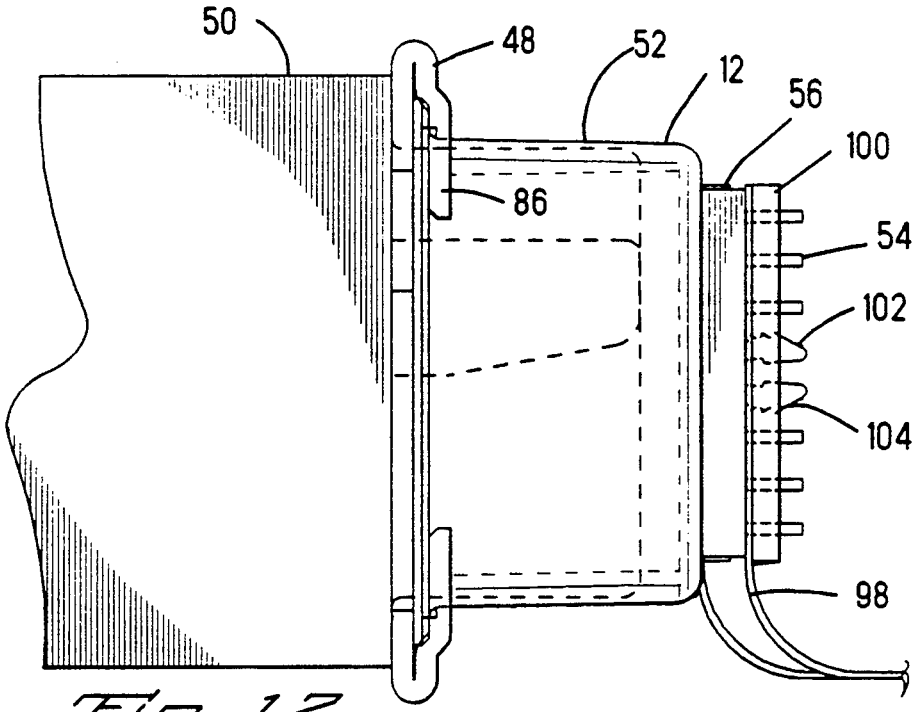
FIG. 12 shows a side view of the connector secured to a panel mated with a complementary connector and having the contacts of the connector interconnected to traces on a medium.
Figure 14:
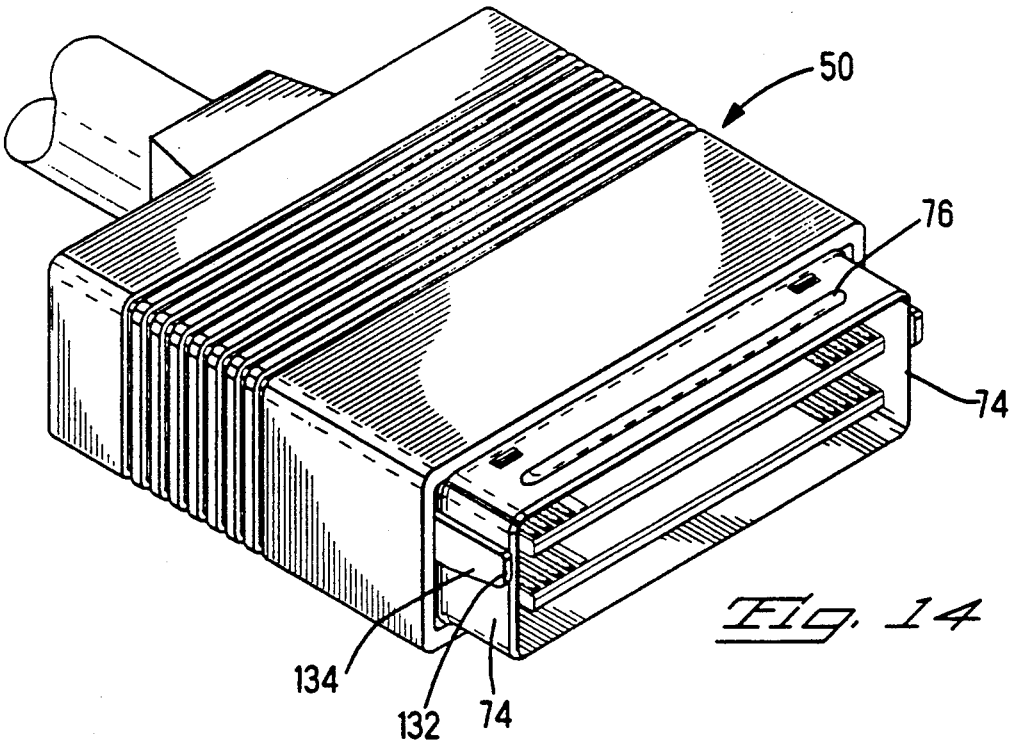
FIG. 14 shows a front perspective view of a mating connector to mate with one of the connectors secured to the panel in FIG. 1.

Contacts 54 may be conductive with traces on a circuit board or, as shown in FIG. 12, with traces 96 on flexible film laminate 98. When flexible film laminate 98 is used, a back-up epoxy resin board 100 is used to maintain flexible film laminate 98 on the contacts. This achieved by boardlock 102 being received in an aperture 104 of epoxy resin board 100 with barbs on boardlock 102 engaging the sidewall of aperture 104 to secure the epoxy resin board to the connector with the flexible film laminate pressed against the bottom surface of the connector. FIG. 12 also shows a complementary connector mated to connector 12 through panel aperture 30.

Figure 13:
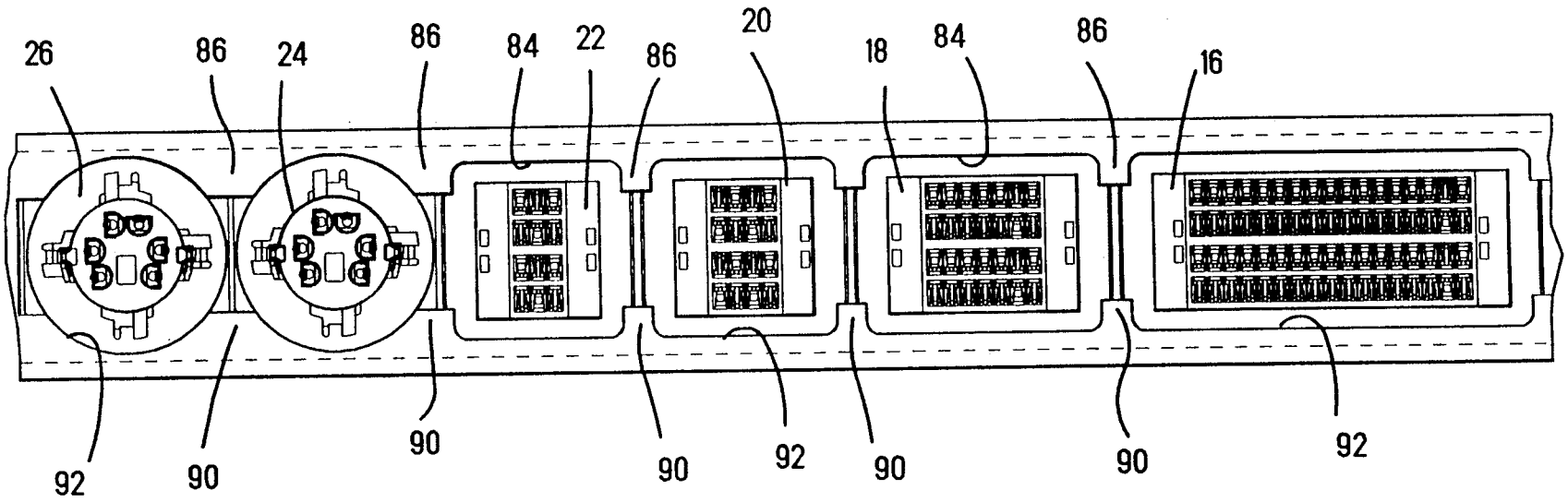
FIG. 13 shows a rear view of the panel with connectors secured thereto.

FIG. 13 shows a rear view of panel 48 with connectors 12-28 secured thereto. In this view it is more evident how the edges 80 and 84 as well as tabs 86 and 90 cooperate with flange 60 on the connectors to secure the connectors to the panel.

Panel 48 can be mounted in a chassis by hardware or by being captured along edge surfaces, with access to panel 48 in connectors 12-28 for mating with complementary connectors.

While the formation of channels 82 and 94 have been described as folding an edge of panel 48, tab-like members could be formed out of portions of panel 48 to achieve the same function.

In the preferred embodiment, connectors are mounted on panel 48 but they need not be mounted thereon, to be mounted proximate thereto and be accessible through an aperture is sufficient. One or more of the apertures 30-46 may have a profiled opening. Aperture 30 is a typical profiled aperture. Aperture 30 has at least one and preferably opposed stepped sidewalls 120, 122. The stepped sidewalls define an aperture 30 that has a wider first region 124 and a narrower second region 126. Narrower second region 126 results from portions of panel 48 remaining as part of the panels rather than being removed during cutting-out of the aperture due to the stepped sidewalls. The portions, regions 128 and 130, provide polarization features to assure that mating connector 50 is properly oriented to pass through the complementary connector aperture 30 in the panel prior to mating with connector 12. The connector adjacent to the panel need not have any polarization features.

The mating face profile of complementary connector 50 is the same as the profile of aperture 30. Should an attempt be made to mate complementary connector 50 with connector 12, if connector 50 is properly oriented with respect to the profile of aperture 30, mating will ensue. However, if the orientation of connector 50 is not the same as the profile of aperture 30, mating will not ensue. For example if connector 50 is rotated 180 degrees from the profile of aperture 30, the ends 132 of latch members 134 on connector 50 will engage regions 128 and 130, thereby stubbing and preventing mating from occurring due to the improper orientation of connector 50 relative to aperture 30.

We claim:

1. A panel for providing a polarization feature to a connector proximate thereto, said panel comprising:

a plate member having opposed major surfaces with a mating connector receiving aperture extending therebetween, said aperture having a wider first region and a narrower second region, said narrower second region defining a portion of the panel adjacent thereto as a polarization feature adapted to be engaged by a portion of the complementary connector when the complementary connector is not properly oriented for passing through the aperture, said panel having opposed channels;

a connector housing having contacts secured therein; and a shield secured to said connector housing, said shield having a flange member extending along opposed edges for receipt in respective opposed channels in the panel to secure the connector to the panel, whereby a complementary connector having a mating face profile corresponding to the profile of the connector receiving aperture can pass through the aperture in one orientation but not other orientations.

2. A panel as recited in claim 1, wherein the polarization feature is defined by an inward step in a sidewall of the aperture.

3. A panel as recited in claim 1, and further comprising: bent edges on said panel, tabs on said bent edges of said panel overlapping said flange member.

4. A panel as recited in claim 3, and further comprising: a recess in at least one of said bent edges of said panel between said tabs, and said tabs being bendable against said flange member of said connector while said connector is in said recess.

5. A panel as recited in claim 4, wherein, said recess is behind a surface of said panel that engages said flange member of said connector, and said recess is aligned with said aperture.

* * * * *